US006178701B1

(12) United States Patent
De Paepe et al.

(10) Patent No.: US 6,178,701 B1
(45) Date of Patent: Jan. 30, 2001

(54) PORTABLE ROOM

(75) Inventors: Denice D. De Paepe, Algonquin; Henry E. Schmalen, Sleepy Hollow; Russell E. Arnold, St. Charles, all of IL (US)

(73) Assignee: Sears. Roebuck and Co., Hoffman Estates, IL (US)

( * ) Notice: Under 35 U.S.C. 154(b), the term of this patent shall be extended for 0 days.

(21) Appl. No.: 09/135,685

(22) Filed: Aug. 18, 1998

(51) Int. Cl.[7] ..... E04H 1/12

(52) U.S. Cl. ..... 52/36.2; 52/70; 52/71; 52/79.5

(58) Field of Search ..... 52/71, 79.5, 239, 52/70, 36.1, 36.2; 160/351; 312/262, 258

(56) References Cited

U.S. PATENT DOCUMENTS

| | | | | |
|---|---|---|---|---|
| 220,429 | * | 10/1879 | Russell | 52/70 |
| 435,604 | * | 9/1890 | Hasselman | 52/239 |
| 438,797 | * | 10/1890 | Blair | 312/262 |
| 469,017 | * | 2/1892 | Hodsdon | 52/71 |
| 574,519 | * | 1/1897 | Boughton | 52/70 |
| 1,045,854 | * | 12/1912 | Kevitt et al. | 52/239 |
| 1,449,780 | | 3/1923 | Reinhold . | |
| 1,828,642 | * | 10/1931 | Bunker | 52/70 |
| 1,917,629 | * | 7/1933 | Anderson | 52/71 |
| 2,820,256 | * | 1/1958 | Dahl | 52/36.1 X |
| 2,837,777 | * | 6/1958 | White | 20/2 |
| 3,733,759 | | 5/1973 | Schulte et al. . | |
| 4,037,385 | | 7/1977 | Wahlquist . | |
| 4,380,836 | | 4/1983 | Braxton . | |
| 4,467,572 | * | 8/1984 | Somers et al. | 52/70 |
| 5,630,302 | | 5/1997 | Roseband . | |

FOREIGN PATENT DOCUMENTS

| | | | | |
|---|---|---|---|---|
| 77850 | * | 8/1949 | (CZ) | 52/71 |
| 2090404 | | 1/1972 | (FR) . | |
| 640518 | * | 7/1950 | (GB) | 52/71 |
| 638425 | * | 4/1962 | (IT) | 52/71 |
| 2-272126 | * | 11/1990 | (JP) | 52/71 |

OTHER PUBLICATIONS

International Search Report dated Nov. 11, 1999, PCT Appl. No. PCT/US99/17180.

* cited by examiner

*Primary Examiner*—Laura A. Callo
(74) *Attorney, Agent, or Firm*—Marshall, O'Toole, Gerstein, Murray & Borun

(57) ABSTRACT

In order to provide a portable room suited for human use, the room is provided with a plurality of walls including three solid wall panels and a fourth wall panel defining a door opening for receiving a door therein. The room also includes a door hingedly mounted for movement between opened and closed positions relative to the door opening defined by the fourth wall panel. Each of the wall panels has a wall supporting post operatively associated with at least one of the opposite ends thereof The room also includes hinge means joining each of the wall panels to an adjacent wall panel for collapsible folding movement of the wall panels relative to each other. With this arrangement, a removable ceiling is supported on the wall panels and, in a preferred embodiment, cooperates with the wall panels to maintain adjacent ones in substantially perpendicular relation.

28 Claims, 4 Drawing Sheets

PORTABLE ROOM

FIELD OF THE INVENTION

The present invention generally relates to portable structures having the ability to be quickly assembled and disassembled and, more particularly, to a portable room that has a structure as well as characteristics which make it well suited for human use.

BACKGROUND OF THE INVENTION

Over the years, there have been many portable structures that have been developed for a wide range of differing applications. It is generally the case with all such structures that one important goal is to provide for rapid assembly of the structure for its intended use. For some applications, there is little else that matters whereas for human use there are additional needs that must be met.

For instance, it will be appreciated that air circulation may well be an important attribute if the room is to be sufficiently comfortable for a human occupant. It is also typically the case in many applications that the room will need to provide a significant degree of privacy for human occupants, i.e., that the human occupants not be visible from outside the room. Additionally, the human occupants must have adequate lighting, particularly where the portable room is assembled where there is no source of natural light to serve this purpose.

In addition to these requirements, it is important to meet the requirements for nearly all portable rooms, i.e., that it be capable of rapid assembly and disassembly. It is also desirable in many applications to have an effective and efficient manner of transporting the portable room from one location to another when it is desired to disassemble the room at one location, transport it to another location, and reassemble the room for use at the latter location. In other words, the portable room should be constructed so as to cooperate with a transportable carrying case in such manner as to be capable of meeting this requirement.

In one particular application, a portable room can be desirable for utilization as a fitting room especially within modem retail settings such as major department stores and the like. It is often important to be able to modify or change the interior configuration of major department stores without facing the need to tear out permanent internal structures such as walls, shelving systems, and fitting rooms only to have to build new permanent structures in differing arrangements to meet changing needs. In other words, modern retailing is such that major department stores should be a shell with the internal structure having portability characteristics for efficient and cost-effective space reconfiguration.

The present invention is directed to overcoming one or more of the foregoing problems and achieving one or more of the resulting objects.

SUMMARY OF THE INVENTION

Accordingly, it is an object of the present invention to provide a portable room that can quicldy and easily be assembled, later disassembled, and still later reassembled for reuse. It is also an object of the present invention to provide a portable room having a transportable carrying case to facilitate transport of the portable room from one location to another. Additionally, it is an object of the present invention to provide a portable room having air circulation, privacy, and illumination for human occupants as, e.g., a fitting room.

As a result, the present invention is directed to a portable room having a plurality of walls including three solid wall panels and a fourth wall panel defining a door opening for receiving a door therein. The room also includes a door hingedly mounted for movement between opened and closed positions relative to the door opening defined by the fourth wall panel. Each of the wall panels has a wall supporting post operatively associated with at least one of the opposite ends thereof The room also includes hinge means joining each of the wall panels to an adjacent wall panel for collapsible folding movement of the wall panels relative to each other. With this arrangement, a removable ceiling is supported on the wall panels and, in a preferred embodiment, cooperates with the wall panels to maintain adjacent ones in substantially perpendicular relation.

In one respect, at least one of the wall panels has a height dimension which is less than the height of the wall supporting posts to provide a space suitable for air circulation. The air circulation space is advantageously disposed between the bottom of the wall panel(s) and a supporting surface for the wall supporting posts. With this arrangement, the removable ceiling has at least one opening which with the air circulation space cooperates to permit air circulation through the portable room.

In another respect, the portable room is provided with a transportable carrying case having an internal width dimension generally commensurate with the greatest width of the wall panels. The transportable carrying case also advantageously has a height dimension for receiving the four wall panels after collapsible folding movement and also for receiving the door and the removable ceiling therewithin. With this arrangement, the four wall panels are preferably collapsible by folding movement using the hinge means to a width which is no greater than the greatest width of the four wall panels.

In addition, one of the four wall panels preferably includes a panel portion at one end thereof extending generally perpendicular to the remainder of that one of the wall panels. Advantageously, the hinge means joining the one end of that wall panel is associated with the free edge of the panel portion so that the adjacent wall panel can undergo folding movement relative thereto by reason of the hinge means. With this construction, the hinge means joining the other end of that wall panel is such that the adjacent wall panel can undergo folding movement prior to the wall panel adjacent the free edge of the panel portion.

With regard to the removable ceiling, the wall panel cooperating means preferably comprises a flange extending generally parallel to each of the four edges of the removable ceiling which is advantageously shaped so as to be generally rectangular. The flanges define a generally rectangular recess for receiving the upper edges of the wall panels therewithin. In a highly preferred embodiment, the flanges each include an inner flange portion and an outer flange portion spaced apart by a distance generally commensurate with the thickness of the wall panels to define a wall panel-receiving channel therebetween.

With regard to the air circulation opening in the removable ceiling, the room preferably also includes means for restricting visibility from ceiling-mounted security cameras therethrough. The visibility restricting means advantageously comprises a gridwork patterned insert disposed within the opening so as to permit air flow while at the same time restricting visibility from above the portable room. Still additionally, the removable ceiling preferably has a fight fixture integral therewith and the light fixture has an electrical cord and plug extending therefrom for supplying electricity for utilizing the light fixture in order to be able to illuminate the portable room.

As for other details of the present invention, the wall panels preferably include a rear wall panel having a perpendicular panel portion, a front wall panel narrower in width than the rear wall panel by the width of the door, a wider side wall panel and a narrower side wall panel adjacent the panel portion. Advantageously, the wider side wall panel is foldable into confronting relation to the rear wall panel, the front wall panel is foldable into confronting relation to the narrower side wall panel, and the folded front wall panel and narrower side wall panel are foldable into confronting relation to the folded wider side wall panel.

With this construction, the hinge means preferably comprise piano hinges and the door is hingedly mounted to a wall supporting post on the wider side wall panel by a plurality of door hinges on the door and a corresponding plurality of post hinges on the wall supporting post. The door hinges are secured to the post hinges with hinge pins. Additionally, the door preferably has louvers in order to restrict visibility therethrough while at the same time accommodating air circulation through the louvers and the air circulation opening in the removable ceiling to provide comfort for a human occupant within the portable room.

In a most highly preferred embodiment, the portable room may further advantageously include a removable mirror, a removable shelf, and at least one removable hook for articles of clothing.

Other objects, advantages and features of the present invention will become apparent from a consideration of the following specification taken in conjunction with the accompanying drawings.

DETAILED DESCRIPTION OF THE PREFERRED EMBODIMENT

Figure 1:
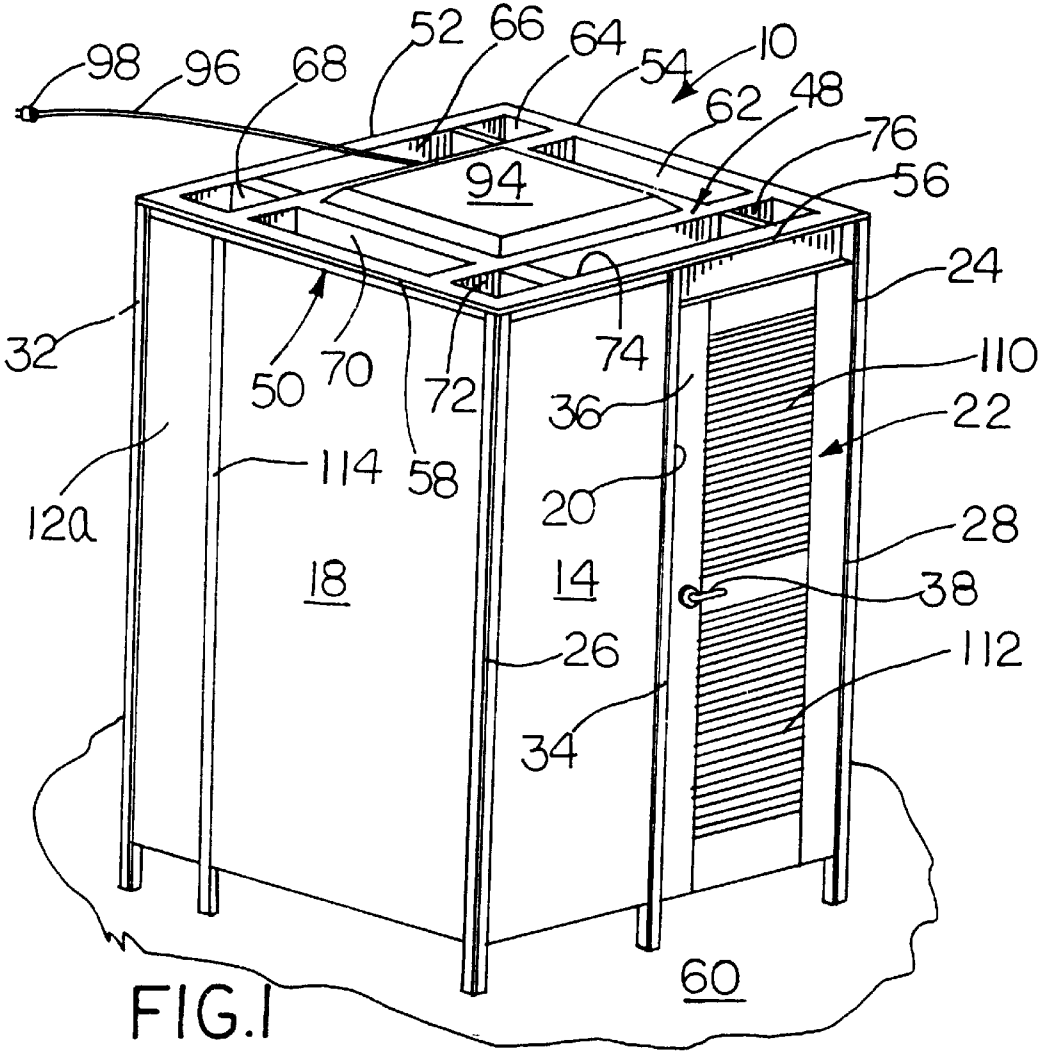
FIG. 1 is a perspective view of a portable room in accordance with the present invention.

In the illustrations given and with reference first to FIG. 1, the reference numeral 10 designates generally a portable room in accordance with the present invention. The portable room 10 includes a plurality of walls including four wall panels 12, 14, 16, and 18 with at least one of the wall panels 14 defining a door opening 20 therein. The portable room also includes a door 22 hingedly mounted as at 24 for movement between opened and closed positions relative to the door opening 20 defined by the one wall panel 14. With this construction, the four wall panels 12, 14, 16, and 18 each have at least one wall supporting post operatively associated with at least one of the opposite ends thereof More specifically, and referring to FIGS. 1 and 2, the portable room 10 includes wall supporting posts 26, 28, 30, and 32 at each of the corners as well as an additional wall supporting post 34 between the wall supporting posts 26 and 28 to define one side of the door opening 20. The wall supporting post 34 cooperates with the free edge 36 of the door 22, i.e., the post 34 is formed to include a doorstop and carries a strikeplate to receive a conventional latch and lock mechanism which is operated in conventional fashion by the door handles 38 and 40. With this arrangement, the various wall supporting posts 26, 28, 30, 32, and 34 may have conventional disk levelers associated with their bottom ends to level the portable room 10 when it is assembled on a supporting surface such as a floor for use in a setting such as a retail store.

Figure 2:
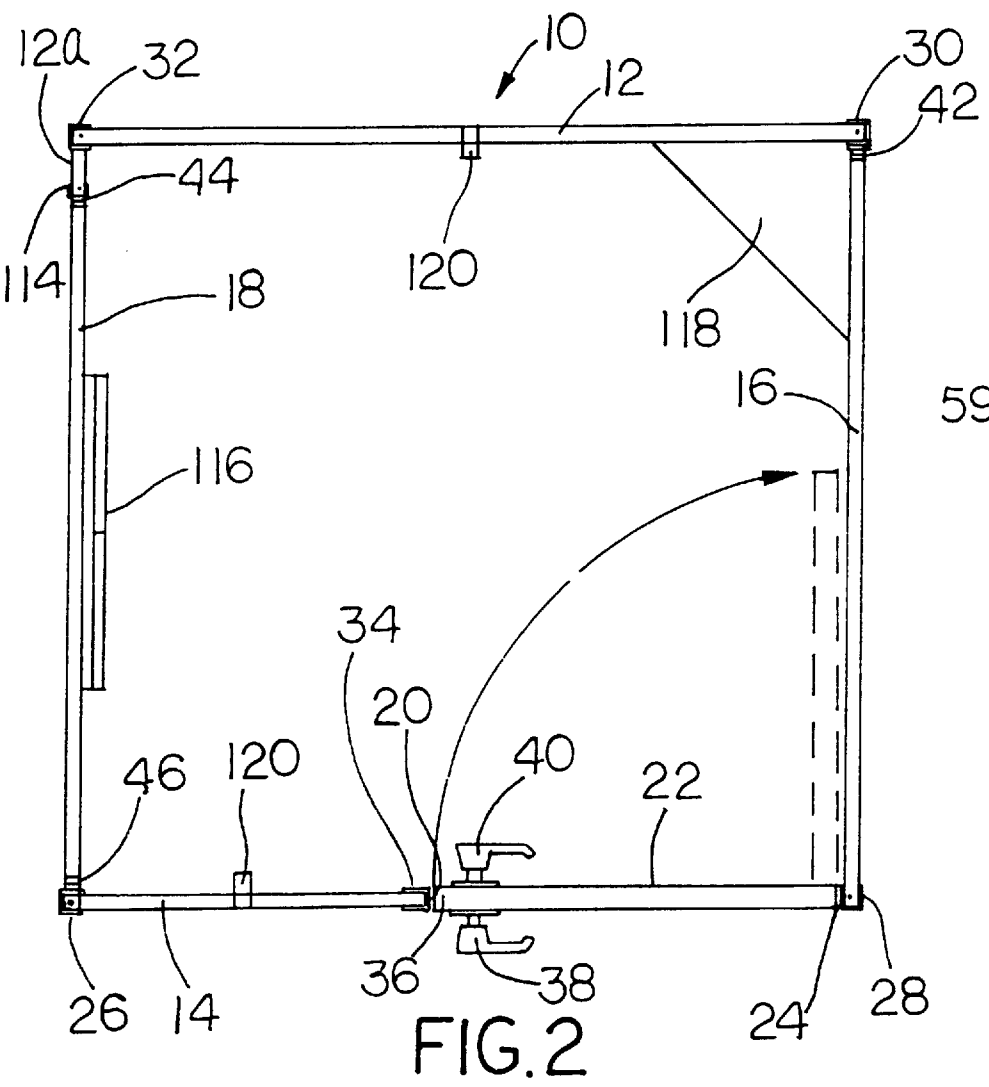
FIG. 2 is a section of FIG. 1 taken just below the door handle and looking upwardly with the ceiling removed.
Figure 5:
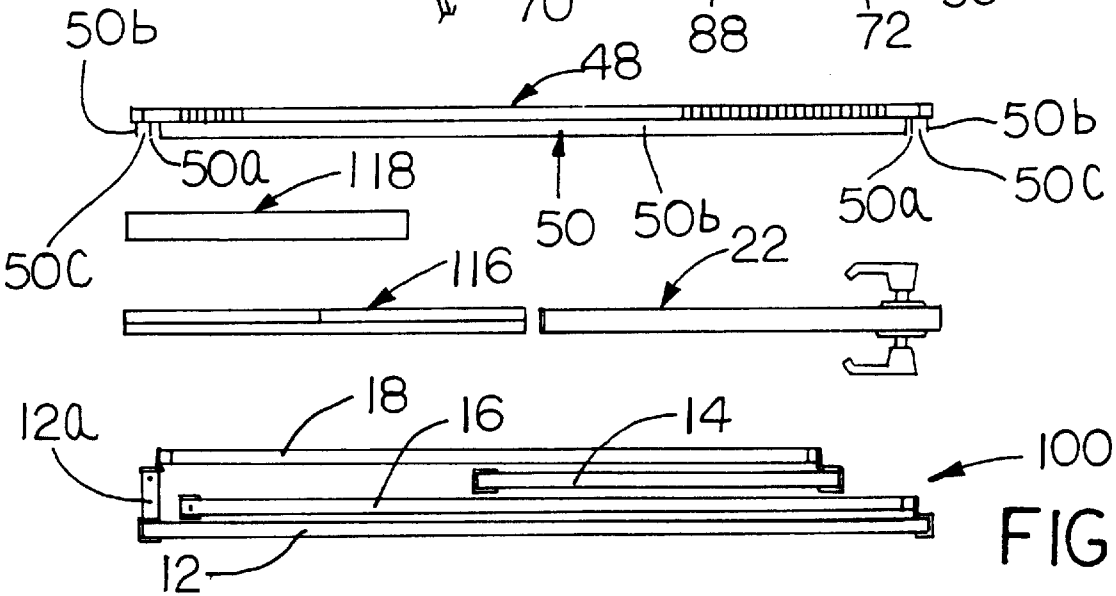
FIG. 5 is an exploded end elevation of the portable room components after removal from the transportable carrying case.

Referring to FIG. 2, the portable room 10 includes a piano hinge as at 42, 44, and 46 for joining each of the four wall panels for collapsible folding movement relative to each other. The hinges 42, 44, and 46 cooperate with the four wall panels so that they are collapsible by folding movement to a width which is no greater than the greatest width of the four wall panels. As best shown in FIG. 5, the wall panel 12 is of the greatest width and the wall panels 14, 16, and 18 are collapsible by folding movement to no greater than this width.

Figure 6:
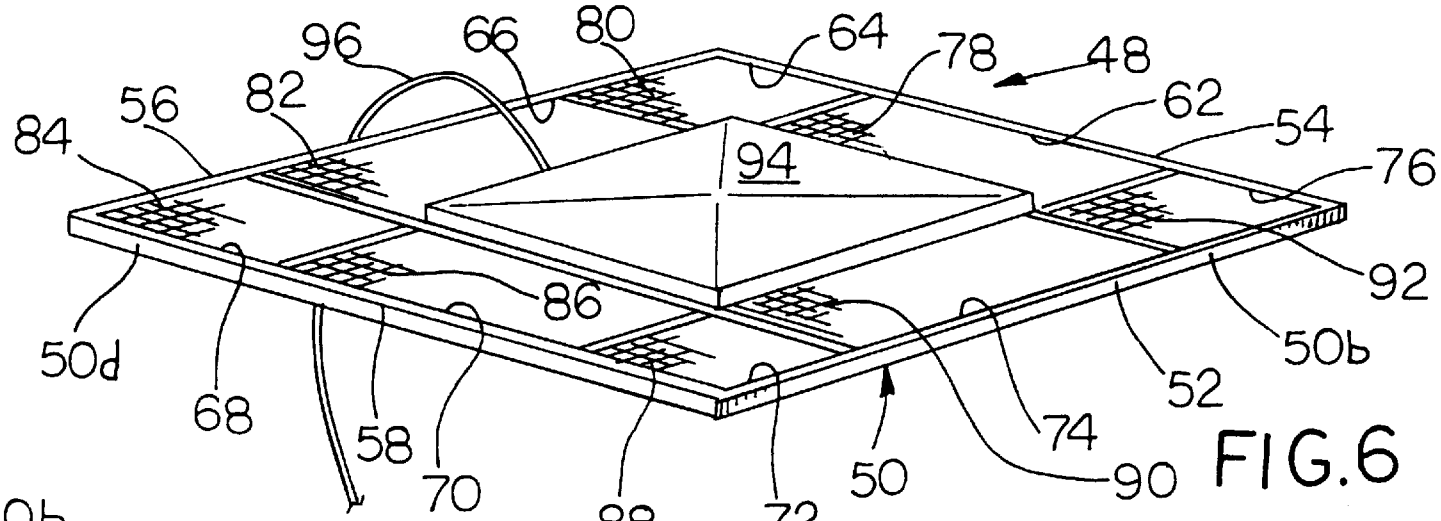
FIG. 6 is a perspective view of a removable ceiling for use on the portable room of FIG. 1.

As shown in FIGS. 1 and 6, the portable room 10 also includes a removable ceiling 48 having means cooperating with upper edges of the four wall panels 12, 14, 16, and 18 for maintaining adjacent ones of the four wall panels substantially perpendicular. This advantageously comprises a flange such as 50 extending generally parallel to each of the four edges 52, 54, 56, and 58 of the removable ceiling 48 wherein the ceiling is generally rectangular and the flanges 50 define a generally rectangular recess for receiving the upper edges of the wall panels 12, 14, 16, and 18 therewithin. In the preferred embodiment, the flanges 50 each include an inner flange portion 50*a* and an outer flange portion 50*b* spaced apart by a distance generally commensurate with the thickness of the wall panels 12, 14, 16, and 18 to define a wall panel-receiving channel 50*c* therebetween.

Figure 4:
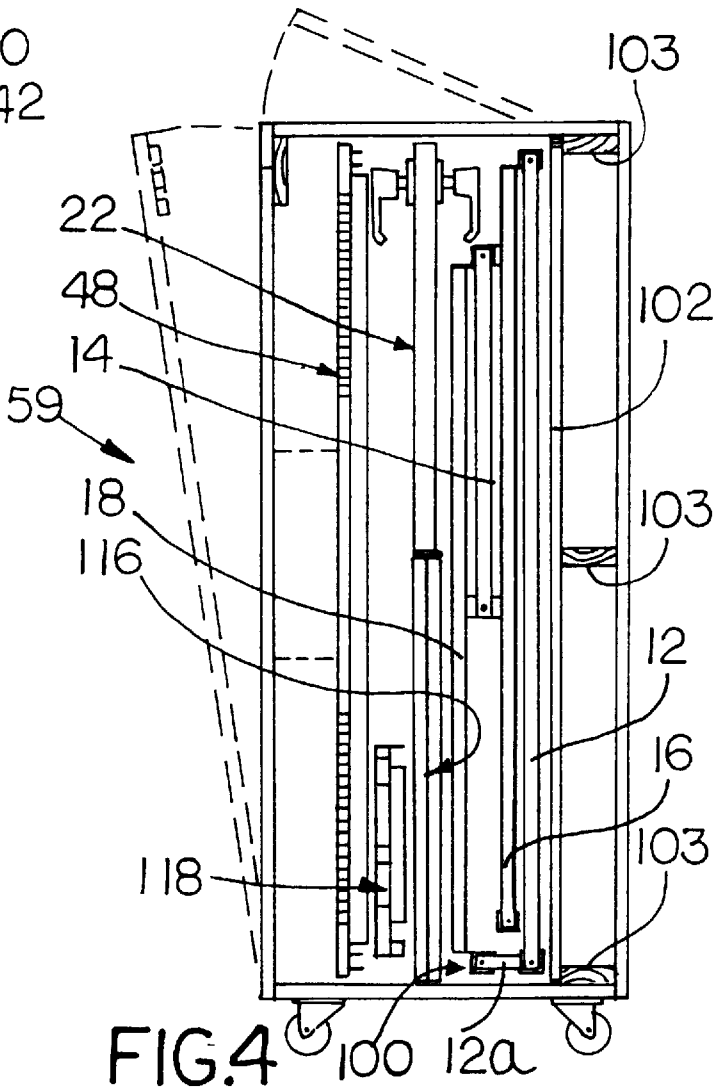
FIG. 4 is an end elevation of FIG. 3 with end panel removed showing the portable room components within the carrying case.
Figure 3:
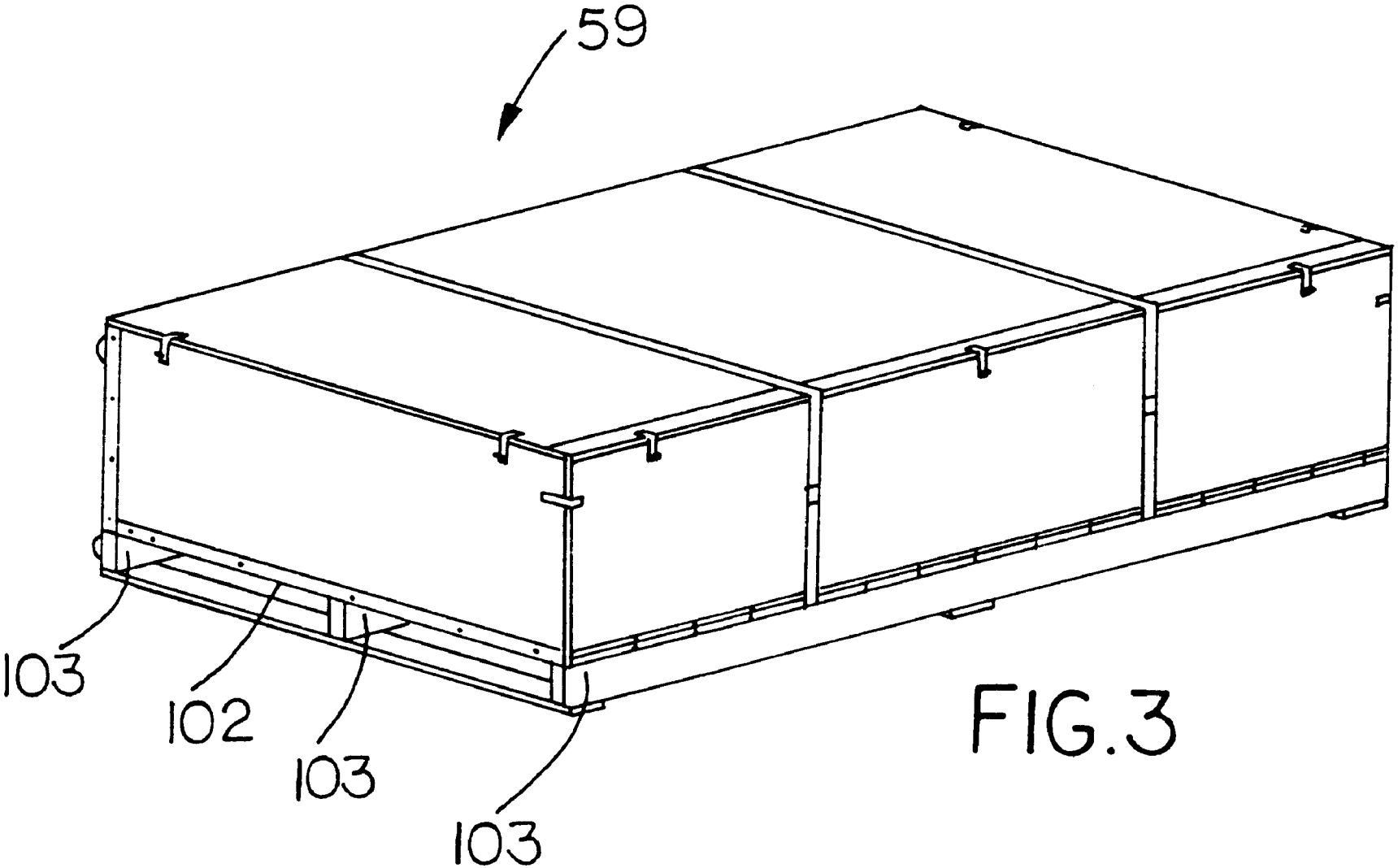
FIG. 3 is a perspective view of a transportable carrying case for the portable room of FIG. 1.

As shown in FIGS. 3 and 4, a transportable carrying case 59 is advantageously provided having an internal width dimension generally commensurate with the greatest width of the wall panels 12, 14, 16, and 18 after collapsible folding movement (compare FIGS. 4 and 5). The transportable carrying case 59 will also be understood to have an internal width dimension greater than the width of the door 22 and greater than the width of the removable ceiling 48. Still additionally, the transportable carrying case 59 will be understood to have a height dimension for receiving the four wall panels 12, 14, 16, and 18, the door 22 and the removable ceiling 48 therewithin, and it can have casters to facilitate rolling movement from one location to another.

Referring to FIG. 1, the portable room 10 preferably is constructed such that at least one, and preferably all, of the wall panels 12, 14, 16, and 18 have a height dimension less than that of the wall supporting posts 26, 28, 30, and 32 to provide a space for air circulation. The air circulation space is disposed between the bottoms of the wall panels 12, 14, 16, and 18 and a supporting surface 60 such as a floor on which the wall supporting posts 26, 28, 30, 32, and 34 rest to permit the flow of air thereunder. Still additionally, the removable ceiling 48 has at least one, and preferably a plurality of openings 62 - 76 which cooperate with the air circulation space under the bottom of the wall panels 12, 14, 16, and 18 to thereby permit air circulation through the portable room 10.

Still more specifically, the air circulation openings such as 62–76 each include means for restricting visibility from ceiling-mounted security cameras therethrough including respective gridwork patterned inserts such as 78–92 disposed within the corresponding openings 62 - 76 to permit air flow while restricting visibility from above the portable room 10. Still additionally, the removable ceiling 48 also preferably has a light fixture 94 which is integral therewith and the light fixture 94 has an electrical cord 96 and plug 98 extending therefrom for supplying electricity for utilizing the light fixture 94 to provide adequate illumination for a human occupant within the portable room 10.

As best shown in FIGS. 1 and 2, one of the wall panels such as the rear wall panel 12 preferably has a panel portion such as 12*a* at one end which extends generally perpendicular to the remainder of that one of the wall panels, i.e., the rear wall panel 12. The hinge 44 joining the one end of that wall panel is associated with the free edge of the panel portion 12*a* so that the adjacent wall panel 18 can undergo folding movement relative thereto. With this arrangement, the hinge 42 joining the other end of the wall panel 12 is associated therewith so that the adjacent wall panel 16 can undergo folding movement prior to the wall panel 18 which is adjacent the free edge of the panel portion 12*a*.

With reference to FIG. 2, the wall panels 12, 14, 16, and 18 include not only the rear wall panel 12, but also a front wall panel 14 which is narrower in width than the rear wall panel 12 by the width of the door 22, a wider side wall panel 16, and a narrower side wall panel 18 which is located adjacent the panel portion 12*a*. As best shown in FIG. 5, the wider side wall panel 16 is foldable into confronting relation to the rear wall panel 12, the front wall panel 14 is foldable into confronting relation to the narrower side wall panel 18, and the folded front wall panel 14 and narrower side wall panel 18 are foldable into confronting relation to the folded wider side wall panel 16.

With the arrangement just described, the panel set generally designated 100 (see FIG. 5) is collapsibly folded into an extremely compact arrangement. This panel set 100 will be seen after it has been folded and is in its place within the transportable carrying case 59 in FIG. 4. As there shown, the panel set 100 can be placed on an elevated floor 102 provided within the transportable carrying case 102 and is reinforced with structural members 103.

Figure 8:
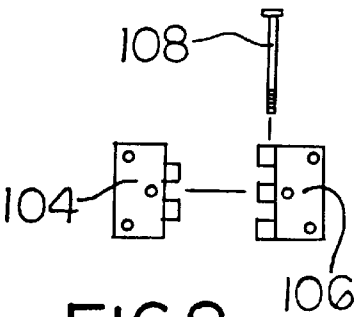
FIG. 8 is an exploded elevation of a door hinge, post hinge and hinge pin for the portable room of FIG. 1.

In the preferred embodiment, the hinges 42, 44, and 46 comprise piano hinges and the door 22 is hingedly mounted to the wall supporting post 28 on the wider side wall panel 16 by utilizing a plurality of door hinges 104 on the door 22 and a corresponding plurality of post hinges 106 on the wall supporting post 28 (see FIG. 8). The door hinges 104 are secured to the post hinges 106 with hinge pins 108. Advantageously, the door 22 is provided with louvers as at 110 and 112 in order to restrict visibility therethrough while at the same time accommodating air circulation through the louvers and the air circulation openings 62–76 in the removable ceiling 48 so as to render the interior suitable for a human occupant therewithin.

With reference to FIG. 1, the portable room 10 may advantageously include a wall supporting post 114 associated with the free end of the panel portion 12*a*. The hinge 44 will be seen from FIG. 2 to be associated with the juncture between the panel portion 12*a* and the wall panel 18 generally at the wall supporting post 114 to accommodate the previously described collapsible folding movement of the various wall panels in the sequence set forth above. With this arrangement, the wall supporting post 114 provides still additional support for the portable room 10 generally at the point of the connection at the hinge 44.

Figures 7A, 7B:
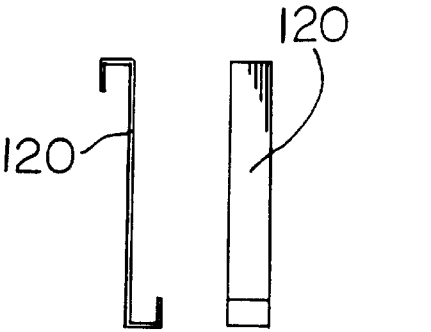
FIG. 7*a* is a side elevation of a coat hook cooperable with a wall panel of the portable room of FIG. 1.
FIG. 7*b* is a front elevation of a coat hook cooperable with a wall panel of the portable room of FIG. 1.

Referring to FIGS. 2, 5, and 6, the portable room 10 may also advantageously include a removable mirror 116, a removable shelf 118, and at least one removable hook 120. The removable mirror 116 and the removable shelf 118 can include conventional horizontally extending, downwardly facing flanges (not shown) that cooperate with corresponding conventional horizontally extending, upwardly facing flanges (also not shown) that vertically interlock upon undergoing relative vertical sliding movement. As for the removable hook(s), FIGS. 7*a* and 7*b* illustrate their shape which permits them to be suspended from the upper edge of the wall panels prior to placement of the removable ceiling thereon.

While in the foregoing there has been set forth a preferred embodiment of the invention, it will be appreciated that the details herein given may be varied by those skilled in the art without departing from the true spirit and scope of the present invention.

What is claimed is:

1. A portable room, comprising:

a plurality of walls including three rigid wall panels and a fourth wall panel having a rigid first portion and a second portion, the second portion defining a door opening for receiving a door therein;

a door hingedly mounted for movement between opened and closed positions relative to the door opening defined by the fourth wall panel second portion;

each of the wall panels having a wall supporting post operatively associated with and rigidly secured to at least one of the opposite ends thereof;

at least one of the wall panels having a height dimension less than that of the wall supporting posts to provide a space for air circulation;

the air circulation space being disposed between the bottom of the wall panel(s) and a supporting surface for the wall supporting posts;

hinge means joining each of the wall panels to an adjacent wall panel for collapsible folding movement of the wall panels relative to each other; and a removable ceiling supported on the wall panels and having at least one opening which with the air circulation space permits air circulation.

2. The portable room of claim 1 wherein each of the wall panels has a wall supporting post operatively associated with each of the opposite ends thereof.

3. The portable room of claim 1 wherein the hinge means accommodates folding of the wall panels to a width no greater than the greatest width of the wall panels.

4. The portable room of claim 1 including a transportable carrying case having an internal width dimension generally commensurate with the greatest width of the wall panels.

5. The portable room of claim 1 including a transportable carrying case having a height dimension for receiving at least the four wall panels after collapsible folding movement.

6. The portable room of claim 1 wherein the removable ceiling includes means for maintaining adjacent ones of the four wall panels substantially perpendicular.

7. The portable room of claim 1 wherein the air circulation opening includes means for restricting visibility from ceiling-mounted security cameras therethrough.

8. The portable room of claim 1 including a light fixture integral with the removable ceiling having an electrical cord and plug extending therefrom.

9. A portable room, comprising:

a plurality of walls including three rigid wall panels and a fourth wall panel having a rigid first portion and a second portion, the second portion defining a door opening for receiving a door therein:

a door hingedly mounted for movement between opened and closed positions relative to the door opening defined by the fourth wall panel second portion, each of the wall panels having a wall supporting post operatively associated with and rigidly secured to at least one of the opposite ends thereof:

at least one of the wall panels having a height dimension less than that of the wall supporting posts to provide a space for air circulation. and further wherein one of the wall panels has a panel portion at one end extending perpendicular to the remainder of that one of the wall panels;

the air circulation space being disposed between the bottom of the wall panel(s) and a supporting surface for the wall supporting posts:

hinge means joining each of the wall panels to an adjacent wall panel for collapsible folding movement of the wall panels relative to each other; and a removable ceiling supported on the wall panels and having at least one opening which with the air circulation space permits air circulation.

10. The portable room of claim 9 wherein the hinge means joining the one end of that one of the wall panels is operatively associated with the free edge of the panel portion.

11. A portable room, comprising:

a plurality of walls including four wall panels with at least one of the wall panels defining a door opening for receiving a door therein;

a door hingedly mounted for movement between opened and closed positions relative to the door opening defined by the one wall panel;

each of the four wall panels having at least one wall supporting post operatively associated with and securely affixed to each of the opposite ends thereof;

hinge means joining each of the four wall panels to an adjacent wall panel for collapsible folding movement of the wall panels relative to each other. at least two of the adjacent wall panels being adapted to cooperate with the hinge means to thereby permit folding of the two adjacent wall panels to a collapsed position wherein the two adjacent wall panels receive therebetween the other two wall panels; and a removable ceiling having means cooperating with the four wall panels for maintaining adjacent ones of the four wall panels substantially perpendicular.

12. The portable room of claim 11 including a transportable carrying case having an internal width dimension generally commensurate with the greatest width of the wall panels.

13. The portable room of claim 11 including a transportable carrying case having a height dimension for receiving at least the four wall panels after collapsible folding movement.

14. A portable room, comprising:

a plurality of walls including four wall panels with at least one of the wall panels defining a door opening for receiving a door therein and wherein another one of the wall panels has a panel portion at one end extending perpendicular to the remainder of the another one of the wall panels;

a door hingedly mounted for movement between opened and closed positions relative to the door opening defined by the one wall panel:

each of the four wall panels having at least one wall supporting post operatively associated with and securelv affixed to each of the opposite ends thereof:

hinge means joining each of the four wall panels to an adjacent wall panel for collapsible folding movement of the wall panels relative to each other; and a removable ceiling having means cooperating with the four wall panels for maintaining adjacent ones of the four wall panels substantially perpendicular.

15. The portable room of claim 14 wherein the hinge means joining the one end of that one of the wall panels is operatively associated with the free edge of the panel portion.

16. A portable fitting room and transportable carrying case, comprising:

a plurality of walls including four generally rigid wall panels with at least one of the wall panels defining a door opening for receiving a door therein;

a door hingedly mounted for movement between opened and closed positions relative to the door opening defined by the one wall panel;

each of the four wall panels having at least one wall supporting post operatively associated with at least one of the opposite ends thereof;

hinge means joining each of the four wall panels to an adjacent wall panel for collapsible folding movement of the four wall panels relative to each other such that the four wall panels being collapsible by folding movement using the hinge means to a width which is no greater than the greatest width of the four wall panels;

a removable ceiling having means cooperating with upper edges of the four wall panels for maintaining adjacent ones of the four wall panels substantially perpendicular; and a transportable carrying case having an internal width dimension generally commensurate with the greatest width of the wall panels and a height for receiving the four wall panels after collapsible folding movement, the door and the removable ceiling therewithin.

17. The portable fitting room and transportable carrying case of claim 16 wherein at least one of the wall panels has a height dimension less than that of the wall supporting posts to provide a space for air circulation, the air circulation space being disposed between the bottom of the wall panel (s) and a supporting surface for the wall supporting posts to permit the flow of air thereunder, the removable ceiling having at least one opening therein which cooperates with the air circulation space under the bottom of the wall panel(s) to thereby permit air circulation through the portable room.

18. The portable fitting room and transportable carrying case of claim 16 including a removable mirror, a removable shelf, and at least one removable hook.

19. A portable fitting room and transportable carrying case. comprising:

a plurality of walls including four wall panels with at least one of the wall panels defining a door opening for receiving a door therein;

a door hingedly mounted for movement between opened and closed positions relative to the door opening defined by the one wall panel;

each of the four wall panels having at least one wall supporting post operatively associated with at least one of the opposite ends thereof;

hinge means joining each of the four wall panels to an adjacent wall panel for collapsible folding movement of the four wall panels relative to each other such that the four wall panels being collapsible by folding movement using the hinge means to a width which is no greater than the greatest width of the four wall panels;

wherein one of the wall panels has a panel portion at one end extending perpendicular to the remainder of that one of the wall panels, the hinge means joining the one end of that wall panel being associated with the free edge of the panel portion so that the adjacent wall panel can undergo folding movement relative thereto, the hinge means joining the other end of that wall panel being associated therewith so that the adjacent wall panel can undergo folding movement prior to the wall panel adjacent the free edge of the panel portion;

a removable ceiling having means cooperating with upper edges of the four wall panels for maintaining adjacent ones of the four wall panels substantially perpendicular: and a transportable carrying case having an internal width dimension generally commensurate with the greatest width of the wall panels and a height for receiving the four wall panels after collapsible folding movement, the door and the removable ceiling therewithin.

20. A portable room, comprising:

a plurality of walls including four wall panels with at least one of the wall panels defining a door opening for receiving a door therein;

a door hingedly mounted for movement between opened and closed positions relative to the door opening defined by the one wall panel;

each of the four wall panels having at least one wall supporting post permanently secured thereto;

hinge means joining each of the four wall panels to an adjacent wall panel for collapsible folding movement of the wall panels and their associated wall supporting posts relative to each other, at least one of the walls being adapted so that the one wall is disposed in spaced relationship from an adjacent wall upon folding movement thereof; and a removable ceiling having means cooperating with the four wall panels for maintaining adjacent ones of the four wall panels substantially perpendicular, the wall panel cooperating means including a flange extending generally parallel to each of four edges of the removable ceiling.

21. The portable room of claim 20 wherein the removable ceiling is generally rectangular and the flanges define a generally rectangular recess for receiving upper edges of the wall panels.

22. The portable room of claim 21 wherein the flanges each include an inner flange portion and an outer flange portion defining a wall panel-receiving channel.

23. The portable room of claim 22 wherein each of the wall panel-receiving channels is perpendicular to the two next adjacent wall panel-receiving channels.

24. A portable fitting room and transportable carrying case, comprising:

a plurality of walls including four wall panels with at least one of the wall panels defining a door opening for receiving a door therein;

a door hingedly mounted for movement between opened and closed positions relative to the door opening defined by the one wall panel;. each of the four wall panels having at least one wall supporting post operatively associated with at least one of the opposite ends thereof;

hinge means joining each of the four wall panels to an adjacent wall panel for collapsible folding movement of the four wall panels relative to each other such that the four wall panels being collapsible by folding movement using the hinge means to a width which is no greater than the greatest width of the four wall panels;

a removable ceiling having means cooperating with upper edges of the four wall panels for maintaining adjacent ones of the four wall panels substantially perpendicular, the wall panel cooperating means further having a flange extending generally parallel to each of four edges of the removable ceiling, the removable ceiling being generally rectangular and the flanges defining a generally rectangular recess for receiving upper edges of the wall panels therewithin, the flanges each including an inner flange portion and an outer flange portion spaced apart by a distance generally commensurate with the thickness of the wall panels to define a wall panel-receiving channel therebetween; and a transportable carrying case having an internal width dimension generally commensurate with the greatest width of the wall panels and a height for receiving the four wall panels after collapsible folding movement, the door and the removable ceiling therewithin.

25. A portable fitting room and transportable carrying case, comprising:

a plurality of walls including four wall panels with at least one of the wall panels defining a door opening for receiving a door therein;

a door hingedly mounted for movement between opened and closed positions relative to the door opening defined by the one wall panel;

each of the four wall panels having at least one wall supporting post operatively associated with at least one of the opposite ends thereof;

hinge means joining each of the four wall panels to an adjacent wall panel for collapsible folding movement of the four wall panels relative to each other such that the four wall panels being collapsible by folding movement using the hinge means to a width which is no greater than the greatest width of the four wall panels;

a removable ceiling having means cooperating with upper edges of the four wall panels for maintaining adjacent ones of the four wall panels substantially perpendicular, the ceiling further including an opening, the opening having means for restricting visibility from ceiling-mounted security cameras therehrough, the visibility restricting means comprising a gridwork patterned insert disposed within the opening to permit air flow while restricting visibility from above the portable room, the removable ceiling also having a light fixture integral therewith and having an electrical cord and plug extending therefrom for supplying electricity for utilizing the light fixture to illuminate the portable room; and a transportable carrying case having an internal width dimension generally commensurate with the greatest width of the wall panels and a height for receiving the four wall panels after collapsible folding movement, the door and the removable ceiling therewithin.

26. A portable fitting room and transportable carrying case, comprising:

a front wall panel defining a door opening for receiving a door therein, a rear wall panel having a panel portion at one end extending perpendicular to the remainder of the rear wall panel, the front wall panel being narrower in width than the rear wall panel by the width of the door, a wider side wall panel and a narrower side wall panel adjacent the panel portion, the wider side wall panel being foldable into confronting relation to the rear wall panel, the front wall panel being foldable into confronting relation to the narrower side wall panel, and the folded front wall panel and narrower side wall panel being foldable into confronting relation to the folded wider side wall panel;

a door hingedly mounted for movement between opened and closed positions relative to the door opening defined by the front wall panel;

each of the four wall panels having at least one wall supporting post operatively associated with at least one of the opposite ends thereof;

hinge means joining each of the four wall panels to an adjacent wall panel for collapsible folding movement of the four wall panels relative to each other such that the width which is no greater than the greatest width of the four wall panels, the hinge means joining the narrower side wall panel to a free edge of the panel portion so that the narrower side wall panel can undergo folding movement relative to the rear wall panel, the hinge means further joining the wider side wall panel to another edge of the rear wall panel so that the wider side wall panel can undergo folding movement prior to the narrower side wall panel;

a removable ceiling having means cooperating with upper edges of the four wall panels for maintaining adjacent ones of the four wall panels substantially perpendicular; and a transportable carrying case having an internal width dimension generally commensurate with the greatest width of the wall panels and a height for receiving the four wall panels after collapsible folding movement, the door and the removable ceiling therewithin.

27. The portable fitting room and transportable carrying case of claim 26 wherein the hinge means comprises piano hinges and the door is hingedly mounted to a wall supporting post on the wider side wall panel by a plurality of door hinges on the door and a corresponding plurality of post hinges on the wall supporting post wherein the door hinges are secured to the post hinges with hinge pins with the door having louvers to restrict visibility therethrough while at the same time accommodating air circulation through the louvers and the air circulation opening in the removable ceiling.

28. A portable room, comprising:

a plurality of rigid walls, a front one of the walls defining a door opening, the front wall and the door opening being adapted to receive a door for substantially closing the opening;

a door hingedly mounted to the front wall;

a plurality of wall supporting posts, the wall supporting posts being operatively associated with at least two of the walls, the wall supporting posts cooperating with their associated walls to thereby support the portable room on a support surface, at least one of the wall supporting posts cooperating with the front wall to define a portion of the door opening;

a plurality of hinges, each of the hinges being adapted to join each of the walls to its adjacent walls, at least one of the hinges being disconnectable, the hinges cooperating with the walls to thereby permit each of the walls to be foldable into confronting relationship with at least one of its adjacent walls; and a removable ceiling being adapted to engage at least some of the walls for maintaining each of the walls substantially perpendicular to its adjacent walls.

* * * * *